US005911878A

United States Patent [19]

Benvenuto et al.

[11] Patent Number: 5,911,878

[45] Date of Patent: Jun. 15, 1999

[54] POOL SKIMMING NET

[76] Inventors: Guido Benvenuto, 8870 Broderick Road, Windsor, Ontario N9A 6Z6; Lanny Elliott, 2018 Charlene, Tecumseh, Ontario B9K 1B1; Dino Coletti, 2670 Brooklyn, Lasalle, Ontario N9H 2L2, all of Canada

[21] Appl. No.: 08/975,455

[22] Filed: Nov. 18, 1997

[51] Int. Cl.[6] ..... E04H 4/16

[52] U.S. Cl. ..... 210/169; 210/232; 210/242.1; 210/483; 210/488; 4/490

[58] Field of Search ..... 4/490, 496; 210/169, 210/242.1, 242.3, 232, 242.4, 242.2, 497.01, 483, 488

[56] References Cited

U.S. PATENT DOCUMENTS

| | | |
|---|---|---|
| 3,625,364 | 12/1971 | La Chance . |
| 3,931,740 | 1/1976 | Carter . |
| 4,089,074 | 5/1978 | Sermons . |
| 4,369,109 | 1/1983 | Edge . |
| 4,836,920 | 6/1989 | Miller, Jr. . |
| 5,108,593 | 4/1992 | D'Ascensio et al. . |
| 5,139,660 | 8/1992 | Lourie et al. . |
| 5,173,181 | 12/1992 | McFarland . |
| 5,223,135 | 6/1993 | MacPhee et al. . |
| 5,279,728 | 1/1994 | Weiss . |
| 5,288,414 | 2/1994 | Mongiello . |
| 5,350,508 | 9/1994 | Van Der Watt . |
| 5,422,001 | 6/1995 | Yagoda et al. . |
| 5,614,085 | 3/1997 | Platt, III . |
| 5,759,388 | 6/1998 | Cote . |
| 5,779,392 | 7/1998 | Mendes . |

FOREIGN PATENT DOCUMENTS

| | | |
|---|---|---|
| 2378905 | 9/1978 | France . |

*Primary Examiner*—Jay H. Woo
*Assistant Examiner*—Fred Prince
*Attorney, Agent, or Firm*—Dykema Gossett PLLC

[57] ABSTRACT

A passive pool skimmer has a T-shaped buoyant stabilizer end and a flexible strap which provides a readily displaceable structure that removes debris from the surface of a pool. The pool skimmer includes a rectangular frame having a net attached thereto in the configuration of a rectangular pouch. At one end of the frame, two floats are attached to the ends of a T-shaped structure. The floats rest against the side of the pool and, in combination with a float at the opposite end of the frame, provides sufficient buoyancy to substantially center the opening of the frame at the water level. A flexible strap with a quick disconnect is attached to the skimmer and allows relative motion of the pool skimmer.

13 Claims, 2 Drawing Sheets

POOL SKIMMING NET

FIELD OF THE INVENTION

The present invention relates generally to devices which are used for cleaning above ground and below ground swimming pools and more specifically relates to passive pool cleaning devices which automatically remove debris from the pool water through the action of circulation currents in the pool.

BACKGROUND OF THE INVENTION

As will be known by those skilled in the art, swimming pools often collect a variety of debris such as leaves, twigs, seeds and other bits and pieces of foliage as well as numerous types of insects. The debris is generally airborne and may initially float on the surface of the water until sufficient water is absorbed by the debris such that it then moves to lower depths of the pool. This floating and submerged debris is highly undesirable to swimmers and generally detracts from the aesthetic value of the pool.

A number of devices have been developed in the art for dealing with pool debris. On the most basic level, debris can be removed from the surface of the pool water through the use of a net on the end of a pole. These manual skimmers are labor-intensive and do not provide a continuous skimming of the surface; that is, they are effective only when manually used to remove debris. While some debris may be removed by filters in association with the pump which circulates the pool water, these types of filters are actually designed more to protect the pump from clogging as a result of a buildup of debris than for providing an efficient means for cleaning the pool water.

Recognizing the desirability of providing a passive pool skimmer, the art has developed a number of approaches. For example, in U.S. Pat. No. 4,369,109 a skimming net for cleaning floating debris from the surface of a pool has a frame which is attached to a side portion of the pool and extends outwardly into the water. A net is slidably positionable over the frame. A quick disconnect assembly is provided for removing the frame and the net from the pool to clear the debris. The frame is rigidly mounted to the edge of the pool with a bracket or the like.

In U.S. Pat. No. 5,173,181, a pool skimming apparatus is disclosed in which a "butterfly net" (i.e. in the nature of a bag) is mounted by quick disconnects to a rigid bracket that is attached to the side of the pool.

In U.S. Pat. No. 5,422,001, a pool skimmer is disclosed in which a bracket is mounted to the side of the pool. The frame is formed of an upper horizontal tube in an inverted U-shape configuration. The device includes a buoyancy component.

In U.S. Pat. No. 4,836,920, a recoil web pool skimmer is described in which a recoiling roll of screening in association with a rotatable spool is disclosed. The screen roll is vertically oriented on a mounting frame which is affixed to the side of the pool.

In U.S. Pat. No. 3,625,364, a skimming device is described in which a pole supports a rectangular screen into the pool water. The pole is rigidly connected to the side of the pool. In U.S. Pat. No. 5,288,414, a pool skimming device in the nature of a net attached to an oval frame is described which is rigidly connected to the side of the pool. Finally, in U.S. Pat. No. 5,277,810, a pool skimmer is disclosed in which a net is suspended from a longitudinal pole which is rigidly mounted to the side of the pool.

The above-described passive skimming devices rely on movement of water through the net in order to collect the debris. They are generally designed such that the net or the frame can be detached to allow the debris to be removed from the screen. Although they may include quick disconnects, they are still rather unwieldly to use in terms of clearing the debris from the net. In addition, they generally require either a custom bracket to fit the edge of the pool, or require that holes be drilled in the side of the pool for attachment. With such means of attachment, little option is provided to optimize the position of the net with respect to the particular pool for the most efficient collection of debris. In addition, these rigidly mounted nets are relatively immovable and may cause injury to a swimmer, particularly one surfacing under or in the vicinity of the net.

Thus, it would be desirable to provide a passive pool skimmer which solves the problems of the prior art which is easily and inexpensively manufactured and which provides pool skimming action. The present invention meets these objectives.

SUMMARY OF THE INVENTION

In one aspect, the present invention provides a fully buoyant pool skimming device which is loosely held in position with a flexible attachment strap that has a quick disconnect clip for rapidly removing the skimmer for removal of debris from the net. The inventive pool skimmer is provided with a generally T-shape floatation device at one end which serves not only to maintain the net in the proper position at the pool surface, but also as a bumper for maintaining the position of the net at the side of the pool. This buoyant, free-mounting stabilization and attachment feature allows the pool skimmer to move easily in response to impact from a swimmer's body; that is, upon being struck the skimmer device can easily move inches or more in response to the force, thereby minimizing any injury potential.

In another aspect, the pool skimming device of the present invention has a rectangular frame on which a net is mounted to form a rectangular shaped pocket on one side of the frame. On one end of the frame a linear float lying along the longitudinal access of the frame is mounted. At the other end, the aforementioned T-shaped float structure is attached to the frame. In the most preferred embodiments, the structures on which the floats are attached are merely extensions of the tubing used to create a rectangular frame.

In another aspect, on the upper part of the frame or net, a first strap section made of a flexible material is connected having one end of a releasable clip. Another strap is provided having a clip which mates with the release clip on the skimmer mounted strap and which has a length which is sufficient to extend to the edge of the pool. The free end of the strap can be held in place on the edge of the pool with any type of weight, such as a small filled sand bag, the leg of a picnic table or chair, or a flowerpot or the like. The flexible attachment strap also facilitates the movement of the skimmer device in response to impact.

These and other advantages and features of the invention will be more clearly understood with reference to the drawing and in connection with the detailed description of the preferred embodiments.

DETAILED DESCRIPTION OF THE PREFERRED EMBODIMENTS OF THE INVENTION

Figure 1:
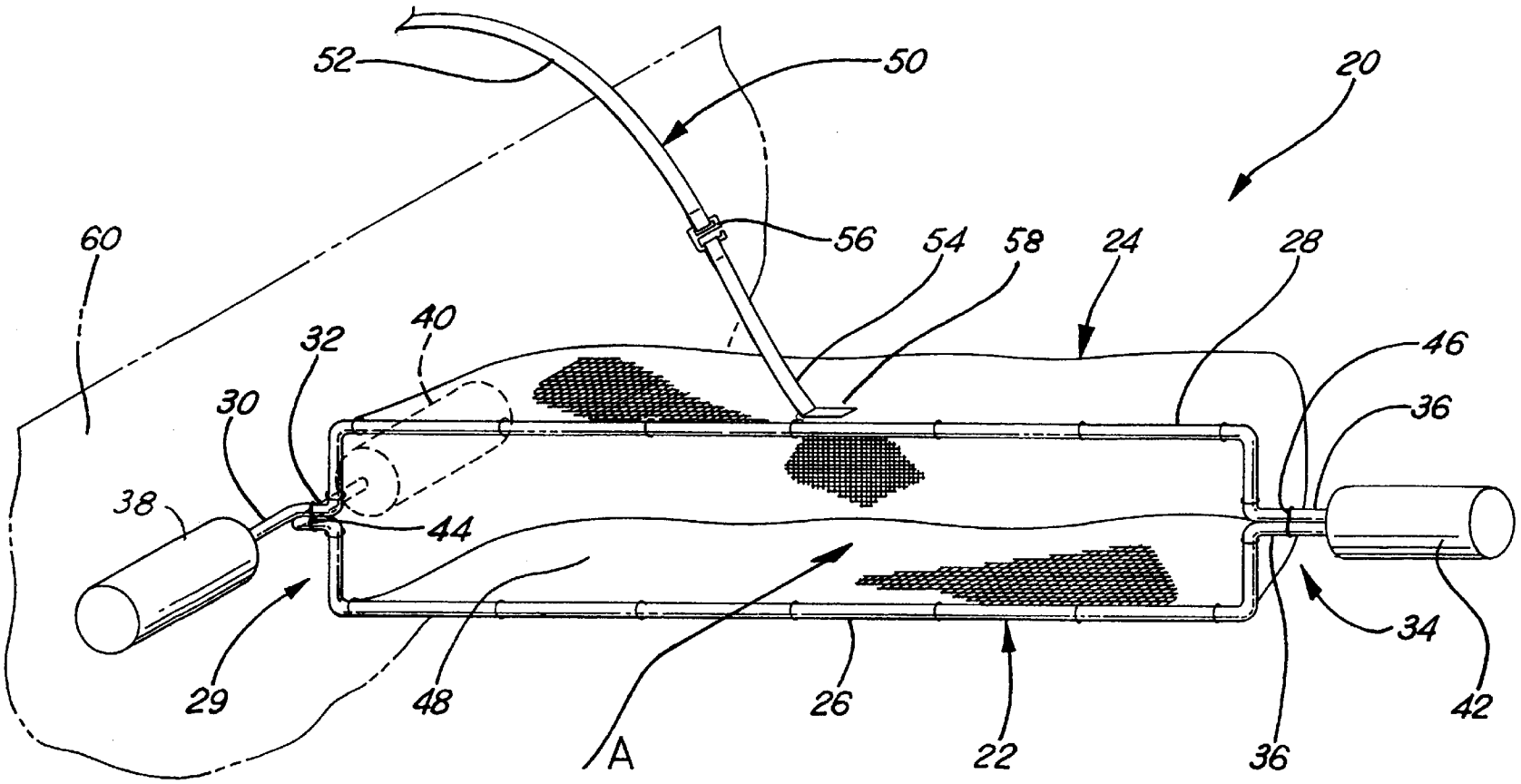
FIG. 1 illustrates a perspective view of the pool skimming device of the present invention.
Figure 2:
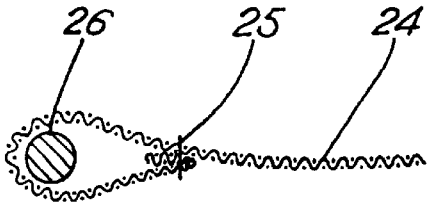
FIG. 2 is a diagrammatic view of one preferred connection of the net to the frame.

Referring now to FIG. 2, pool skimmer 20 is shown generally having frame 22 which is generally rectangular in shape and net 24 which is attached to frame 22 and is in the nature of an open-weave netting similar to that used in more conventional pool skimmers. Thus, it will be understood by those skilled in the art that net 24 is a porous material which allows water to move easily therethrough and is configured in the nature of a "screen pouch" which prevents the passage of most debris.

Figure 3:
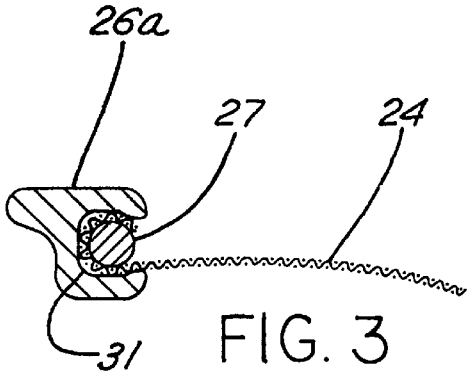
FIG. 3 is a diagrammatic view of another preferred connection of the net to the frame.
Figure 4:
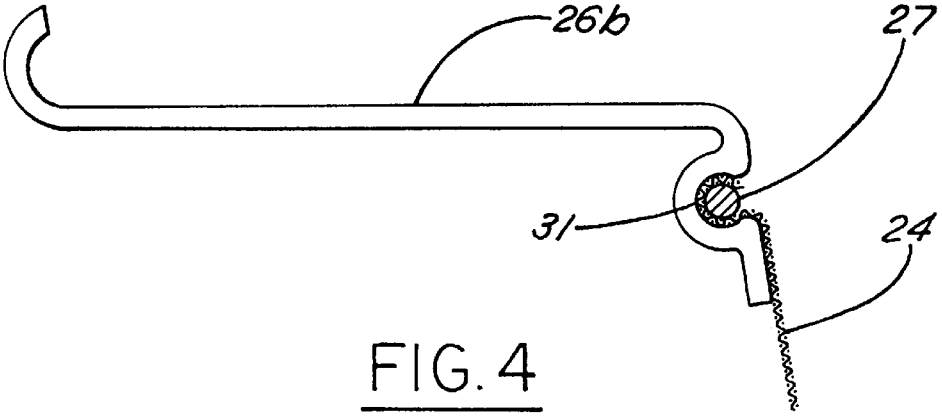
FIG. 4 is a diagrammatic view of another preferred connection of the net to the frame.

Frame 22 in the most preferred embodiment of the present invention is formed of a lower frame member 26 and an upper frame member 28 which may comprise aluminum or plastic tubing or rod or the like or which may be formed of an injection molded or vac formed plastic. In one preferred embodiment, the edges of net 24 are integrally bonded to members 26 and 28 through a molding or other thermally activated process. Alternatively, and referring to FIG. 2 of the drawings, frame member 26 is shown in cross section as an aluminum rod with net 24 being sewn on at loop 25. In FIG. 3 of the drawings, an injection molded frame member 26*a* is shown having a retaining strip 27 that retains net 24 in slot 31. Finally, in FIG. 4, a vac formed sheet 26*b* is used to form frame 22 with retaining strip 27 again holding net 24 in slot 31. At end 29 of frame 22, each upper and lower member (26, 28) is bent such that stabilizing float retaining arms 30 and 32 are formed. Thus, arm 30 extends out from the longitudinal axis of upper frame member 28 (perpendicular to an axis along frame 28) and arm 32 is similarly oriented with respect to the longitudinal axis of lower frame member 26. At end 34 of frame 22, the frame members 26 and 28 are again bent to form two extensions 36 which join together to form a float retaining extension.

An important feature of the present invention is to provide the T-shaped buoyancy and stabilizer assembly at end 29. For buoyancy, float 38 can be seen on arm 30 and float 40 on arm 32. Floats 38 and 40 are typically lightweight foams such as styrofoam or the like. In the preferred embodiment, floats 38 and 40 are cylindrical in shape and have centralized bores such that they can be slipped over and retained on the respective arm, 30, 32. It is important that floats 38 and 40 have sufficient buoyancy to prevent end 29 of pool skimmer 20 from sinking too far below water level. On extension 36, float 42 is shown which, as with floats 38 and 40, is a buoyant material such as styrofoam or the like which has sufficient buoyancy to float on the surface of the water in the pool. Lower member 26 and upper member 28 of frame 22 are, in this embodiment shown held together by fastener 44 at end 29 and fastener 46 at end 34. Any number of fasteners such as a simple metal or plastic clip or the like can be used for this purpose. It is to be understood that floats 38, 40 and 42 have sufficient buoyancy to maintain frame 22 position in the water such that opening 48 is generally centered; that is, lower member 26 of frame 22 is below the water and upper member 28 is above the water. In this manner, water with its entrained debris flows by virtue of the circulation currents in the pool in the direction of arrow A through opening 48 wherein the debris is collected by net 24.

Figure 5:
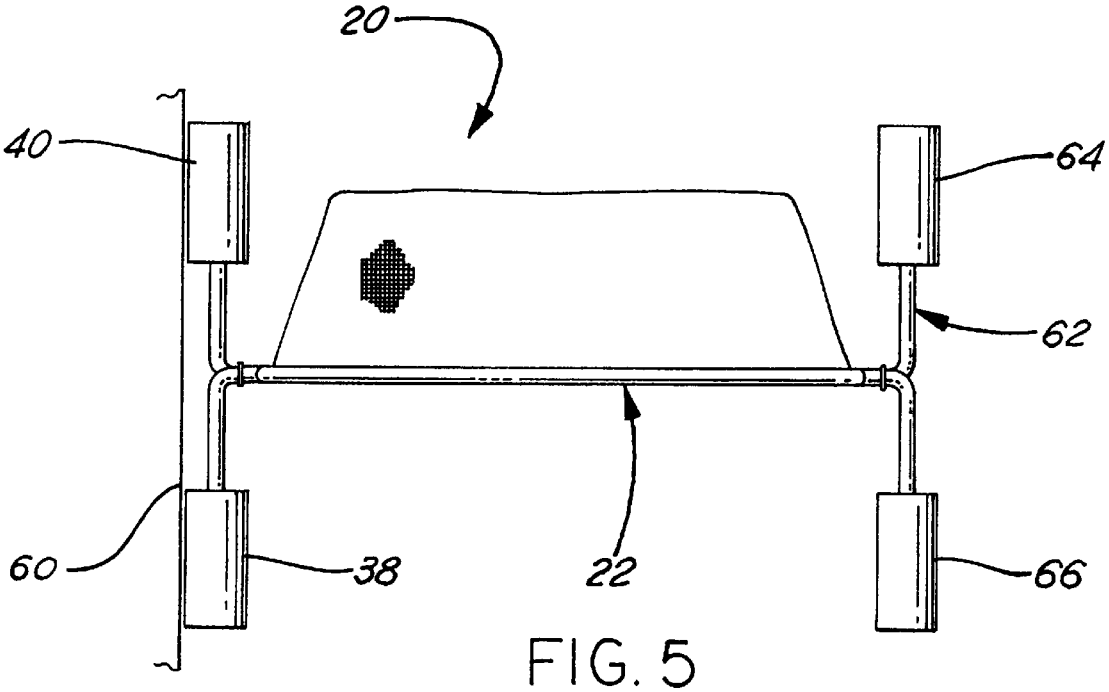
FIG. 5 is a plan view of the pool skimming device in an alternate embodiment.

In another embodiment, as shown in FIG. 5 of the drawings, float 42 is replaced with another T-shaped float arrangement 62 having floats 64 and 66. By providing T-shaped float supports at both ends of skimmer 20, the device is rendered more symmetrical and this construction may simplify manufacture.

Retaining strap 50 is shown having pool side portion 52 and net portion 54 attached to one another by quick release fastener 56 which may be a simple clip or the like. Net portion 54 is attached to net at attachment site 58 which may be a thermally bonded connection or any other number of attachment means such as fasteners or the like.

In operation, portion 52 of strap 50 and portion 54 are connected by virtue of quick release 56. Pool skimmer 20 is placed in position in the pool such that floats 38 and 40 are adjacent wall 58 of the pool. Portion 52 of strap 50 is then anchored using a sandbag or flowerpot or other pool side weight and it is not necessary to permanently affix the strap to a structure. Sufficient tension is applied to strap 50 so that floats 38 and 40 generally remain in contact with pool wall 60. Float 42 provides enough buoyancy such that in combination with floats 38 and 40, frame 22 is held in intermediate water level position such that the water line is approximately half way between upper member 28 and lower member 26. Skimmer 20 should be positioned such that the water currents flow in the direction of arrow A. One of the advantages of the present invention is that one can easily test the best position of skimmer 20 with respect to the pool currents, that is, if it appears that another location would be better in order to maximize the collection of debris, skimmer 20 can be repositioned in a matter of seconds.

Once a sufficient amount of debris is collected, pool skimmer 20 is removed from the pool, quick release 56 is used to disconnect portion 52 from portion 54 and the skimmer is taken to a convenient location for removing the debris. After the debris is removed, the straps are simply reattached to one another and the skimmer is once again placed in the pool. It will be appreciated that strap 50 is of flexible material such as a flexible plastic or the like and that this construction allows skimmer 20 to move up and down in response to movement of the waters and, most importantly, in the event that a swimmer comes into contact with pool skimmer 20, the skimmer easily moves away preventing a serious impact between swimmer and skimmer.

What is claimed is:

1. A pool skimmer, comprising:

a longitudinal frame defining an opening, said frame having a pair of opposed arms integral to said frame and disposed at one end of said frame;

a net attached to said frame and covering said opening;

a first float attached to said one end of said frame;

a second float attached to the other end of said frame; and a flexible strap for holding said frame and net in position in a swimming pool.

2. The pool skimmer recited in claim 1, wherein said first float has two sections, one of said sections being attached to one of said opposed arms and the other of said sections being attached to the other of said arms.

3. The pool skimmer recited in claim 1, wherein said frame defines a rectangular opening.

4. The pool skimmer recited in claim 1, wherein said flexible strap is attached to said net.

5. The pool skimmer recited in claim 1, wherein said frame is tubular.

6. The pool skimmer recited in claim 1, wherein said frame is formed of two pieces of tubing.

7. A pool skimmer, comprising:

a longitudinal frame defining a rectangular opening, said frame including a pair of opposed arms integral to said frame and disposed at one end of said frame;

a net attached to said frame and covering said opening, said net forming a pouch for collecting debris;

a first float attached to said one end of said frame;

a second float attached to the other end of said frame; and a flexible strap for holding said frame and net in position in a swimming pool with said first float against the side of said pool.

8. The pool skimmer recited in claim 7, wherein said longitudinal frame is tubular.

9. The pool skimmer recited in claim 7, wherein said longitudinal frame is formed of two pieces of tubing.

10. A pool skimmer, comprising:

a longitudinal frame formed of two tubes attached to one another and defining a rectangular opening, said frame having a pair of opposed arms integral to said frame and disposed at one end of said frame;

a net thermally fused to said frame and covering said opening, said net forming a pouch for collecting debris;

a first float attached to said one end of said frame;

a second float attached to the other end of said frame; and a flexible strap for holding said frame and net in position in a swimming pool with said first float against the side of said pool.

11. The pool skimmer recited in claim 10, wherein said first and second floats are formed of foam.

12. The pool skimmer recited in claim 10, wherein said first and second floats are positioned relative to said rectangular opening such that said pool skimmer floats in a pool with the water level at the midpoint of said rectangular opening.

13. The pool skimmer recited in claim 7, wherein said first float has two sections, one of said sections being attached to one of said opposed arms and the other of said sections being attached to the other of said arms.

* * * * *